US006763821B1

(12) United States Patent
Kuppler et al.

(10) Patent No.: US 6,763,821 B1
(45) Date of Patent: Jul. 20, 2004

(54) FORCED AIR PROJECTILE ATTACHMENTS

(76) Inventors: Gregory Kuppler, 12127B Galena, Plano, IL (US) 64505; Timothy Raymond, 12127B Galena, Plano, IL (US) 64505

( * ) Notice: Subject to any disclaimer, the term of this patent is extended or adjusted under 35 U.S.C. 154(b) by 0 days.

(21) Appl. No.: 10/348,129

(22) Filed: Jan. 21, 2003

Related U.S. Application Data

(60) Provisional application No. 60/352,183, filed on Jan. 26, 2002.

(51) Int. Cl.[7] ..... F41A 9/61
(52) U.S. Cl. ..... 124/58; 124/73
(58) Field of Search ..... 124/58, 54, 60, 124/74, 75, 76, 81, 83, 85; 42/54, 55

(56) References Cited

U.S. PATENT DOCUMENTS 3,022,597 A * 2/1962 Rucker ..... 42/55
3,889,652 A * 6/1975 Curtis ..... 124/41.1
4,014,307 A * 3/1977 Horvath ..... 124/81
4,157,703 A * 6/1979 Brown et al. ..... 124/55
4,212,284 A * 7/1980 Speer ..... 124/56
5,115,794 A * 5/1992 Moormann ..... 124/65
5,337,726 A * 8/1994 Wood ..... 124/61
5,365,913 A * 11/1994 Walton ..... 124/75
5,448,984 A * 9/1995 Brovelli ..... 124/69
6,119,671 A * 9/2000 Smith et al. ..... 124/59
6,151,824 A * 11/2000 Clayton ..... 42/54
6,152,123 A * 11/2000 Ferrante et al. ..... 124/16
6,276,353 B1 * 8/2001 Briggs et al. ..... 124/71
6,321,737 B1 * 11/2001 Johnson et al. ..... 124/73
6,523,535 B2 * 2/2003 Rehkemper et al. ..... 124/78
6,604,518 B1 * 8/2003 Sanford et al. ..... 124/56

* cited by examiner

*Primary Examiner*—Harold J. Tudor
*Assistant Examiner*—Troy Chambers
(74) *Attorney, Agent, or Firm*—John P. Cooney

(57) ABSTRACT

The projectile attachments to a forced air compression chamber are devices that are attached to force air compression chambers and permit the user to place the projectile in or on the launch chamber prior to operating the air compression chamber thus making for a more fluid movement. The flexible ball projectile attachment allows the user to place one or more balls into the launch chamber and eject the same in a fluid movement without the aid of mechanical devices. Thus increasing the reliability and decreasing the number of moving parts in the typical ball launching device. The flexible dart type projectile attachment allows the user to place the dart type projection on the launch chamber and then suck air into the air compression chamber through the non-tube openings and when air is expelled from the air compression chamber the flexible diaphragm closes over the non-tube holes thus ejecting the dart type projectiles. Thus making the use of the launch chamber more efficient and easier.

10 Claims, 2 Drawing Sheets

FORCED AIR PROJECTILE ATTACHMENTS

CROSS-REFERENCE TO RELATED APPLICATIONS

None.

Provision Application filed Jan. 26, 2002

Application No. 60/352,183

Applicant: Grefory L. Kuppler, Batavia, Ill.

Invention Name: Forced Air Projectile Attachments

Applicant is claiming priority back to Jan. 26, 2001 filing of provisional application.

TECHNICAL FIELD

The invention relates generally to the toy industry as it relates to launching projectiles from a forced air compression chamber used in toys.

BACKGROUND ART

In the past there have been some inventions that have dealt with the launching of flexible balls, darts and similar projectiles from forced air devices. Generally these inventions are specific for a particular projectile and the same forced air compression chamber cannot be used to launch different types of projectiles. Some of these inventions while using forced air as a method of propelling also required the use of a spring to assist the projectile from the end of the launcher. These type of inventions are primarily used for the launching of ball type projectiles. This method has resulted in significant failure of parts and has a more complex mechanism over the present invention In addition, other inventions exist that require the air compression chamber to be filled prior to the placement of the projectile. This resulted in a disjoint three-step process in order to launch the projectile. First, the user fills the air compression chamber that is attached to the launching chamber. Secondly, the user places the projectile into or on the launching chamber while the air compression chamber is full. And, thirdly, the user compresses the air compression chamber to force air out of the air compression chamber ejecting the projectile.

The present invention discloses a launching element that will be placed on the forced air compression chambers that eliminates any mechanical means to launch the projectile except for the use of the compression of air. In addition, the present invention discloses a launching element for ball type projectiles that will be placed on the forced air compression chamber that can be easily removed and replaced with another launching element for dart type projectiles. Further the present invention discloses launching elements for ball and dart type projectiles that will be a fluid two step process for ejecting flexible balls, darts and other projectiles solely utilizing forced air. The user places the projectile in or on the launching elements and the user then fills and expels air from the air compression chamber. The present invention has fewer moving parts and less mechanical steps, as such it reduces costs and increases reliability.

OBJECTS OF THE INVENTION

One object of the invention is to provide a launching element device to be placed on the end of a forced air compression chamber that will use only the forced air and no other mechanical devices to launch the projectiles, thus reducing the possibility of failures.

Another object of the invention is to provide a launching element device to be placed on the end of a forced air compression chamber that will permit the placement of the projectile prior to the filling of the air compression chamber thus producing a more fluid ejection of the projectile.

Another object of the invention is to provide a launching element device to be placed on the end of a forced air compression chamber that can be used with one type of projectile that will be easily replaced by another launching element device to be used with a different projectile, thus increasing the use of the forced air compression chamber.

DISCLOSURE OF THE INVENTION

Forced air projectile launcher attachments, in accordance with the invention, comprising of a launching chamber element that on one end is mechanically attached to an air compression chamber by a means of attachment and the opposite end that will accommodate the projectile to be launched. The launching chamber element shall have an opening or plurality of openings at the end that attaches to the air compression chamber that will permit air to flow into the air compression chamber when the projectile is inserted on or in the launching chamber element. The opening or openings shall permit air to flow from the air compression chamber into the launching chamber element and eject a projectile that will be on or in the launching chamber element.

Preferably, the launching chamber shall have means of attachment to the air compression chamber so that it can be easily replaced with an alternative launching chamber element that utilizes a different projectile.

In accord with one aspect of the invention as it applies to ball type projectiles, the interior of the launching chamber element shall be cylindrical in shape with a tapered interior diameter that initially is slightly smaller in size than the diameter of the intended ball projectile and will gradually increase in diameter so that is slightly larger in size that the diameter of the intended ball projectile at the end closest to the air compression chamber. The length of the launching chamber element shall be at a minimum slightly larger than the diameter of the intended ball projectile and to a length that would permit the launching chamber element to hold a plurality of ball projectiles. The interior of the end of the launching chamber element at the end closest to the air compression chamber shall have an opening in the center of the end of a size that shall be smaller than the intended ball projectile so that air can pass through the launch chamber element into the air compression chamber. The opening in the interior end shall have a plurality of raised posts of a length so that the intended ball projectile cannot seal the opening restricting the air flow into the air compression chamber and shall permit air to flow around the projectile into the air compression chamber element.

Preferably, interior circumference of the end of the launch chamber element furthest from the air compression chamber shall have a lip on the interior of the launching chamber element that protrudes into the launch chamber element and shall be of a diameter slightly smaller than the intended ball projectile(s) so that when air is being expelled from the air compression chamber the lip will form a seal with the ball projectile and permit air pressure to increase in the launch chamber element sufficient to eject the ball projectile. In accord with one aspect of the invention as it applies to dart style or missile projectiles, the launching chamber element for dart projectiles shall be cylindrical in shape. The launching chamber element shall be comprised of a tube element, diaphragm element and base element The base element of the launching chamber element shall have a means of attachment to the air compression chamber. The base element shall be attached to the tube element by a means of attachment that will permit air flow through interior of the tube element and the air compression chamber. The tube element shall be hollow with an uniform exterior diameter that will be slightly larger than the interior diameter of the intended dart/missile projectile so that it will form a airtight seal with the dart/missile projectile when it is placed over the tube element. The opening on the base element shall align with the opening in the tube element and the base element and tube element shall be attached by a means of attachment so that air can only pass rough the tube element into the air compression chamber. The base element shall contain one or more additional opening where air can flow into the air compression chamber. The diaphragm element shall be flexible and have a means of attachment to either the base element or the tube element. The diaphragm element shall be flexible to allow outside air to flow into the air compression chamber when the projectile is placed on the tube element and shall seal the non-tube openings when air is expelled from the air compression chamber so that air will not pass through the non-tube openings and shall pass through the tube element thus allowing air pressure to build up and eject the dart/missile projectile from tube element.

Preferably, the opening in the base element where the tube element is attached to the base element by a means of attachment shall be in the center of the base element. The diaphragm element shall be circular in shape and shall be attached to the end of the tube element that is attached to the base element, by a means of attachment. The base element shall have a plurality of non-tube openings that will be directly above the diaphragm element.

Preferably the launch chambers are manufactured of molded polymer.

BRIEF DESCRIPTION OF THE DRAWINGS

FIG. 2 shows the diaphragm at the position seating the non-tube openings in the base element when air is expelled from the air compression chamber.

DETAILED DISCLOSURE OF INVENTION

Figure 1:
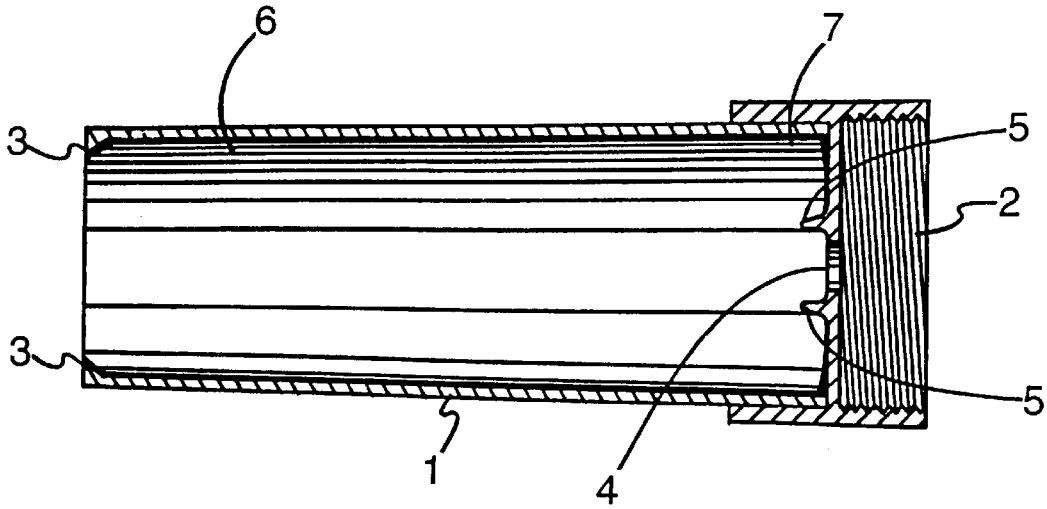
FIG. 1 is a perspective view of the invention for the ball type projectiles, showing the launch chamber element for use with flexible ball type projectiles.

Referring to the drawings, FIG. 1 illustrates dissected view of a ball type launch chamber element (1) that has a means of attachment (2) to an air compression chamber with the opposite end of the launch chamber element (1) having a restricter lip (3) that protrudes into the interior circumference of the launch chamber element (1). The end of the launch chamber element (1) where it is attached to air compression chamber shows a circular opening (4) in the center of the base that is of a smaller diameter than the interior diameter of the launch chamber element (1) and the proposed flexible ball projectile. The end of the launch chamber element (1) closest to the air compression chamber shows a plurality of raised posts (5) on the interior of the launch chamber element (1) surrounding the opening in the base element (4) that permits the ball projectile to rest on the posts and not seal the opening (4). The interior diameter of the launch chamber element (1) shall be tapered so that the diameter of the end of the launch chamber element (1) closest to the air compression chamber (7) shall be slightly larger than the diameter of the intended ball projectile and shall decrease in diameter as it the launch chamber element (1) extends from the air compression chamber to the restricter lip (3). The means of attachment (2) of the launch chamber element (1) shown in FIG. 1 is a threaded screw type means of attachment to the air compression chamber.

Figure 2:
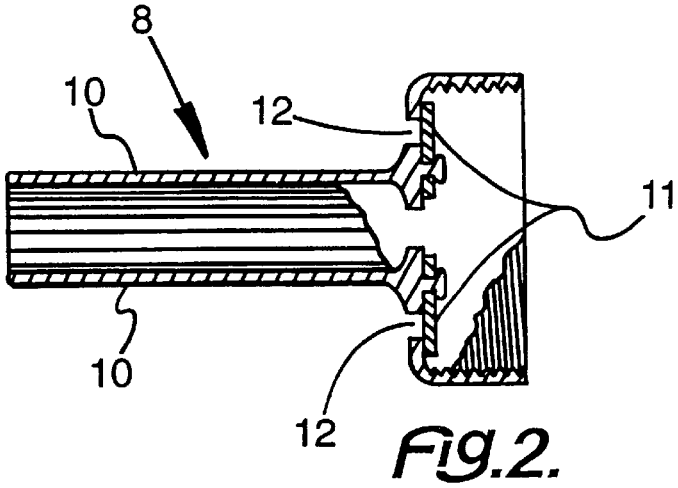
FIG. 2 is a perspective view of the invention for the dart type projectile, showing the preferable method of the tube element in the center of the base element with the diaphragm element attached to the tube clement and the base element with non-tube openings.

Referring to the drawings, FIG. 2 shows a dart/missile type projectile launch chamber element (8) that has a means of attachment at the base element (9) to the air compression chamber. The tube element (10) is a hollow cylinder and is affixed to the base element (9) by a means of attachment so that the tube element (10) forms an airtight seal where attached to the base element (9). The base element has a plurality of circular non-tube openings (12) where air is permitted to pass through into the air compression chamber when a dart or missile is placed over the exterior of the tube element (10) forming an airtight seal of the tube element's (10) opening The diaphragm clement (11) is attached to the tube element (10) by a means of attachment around the tube element's (10) entire circumference where it affixes to the base element (9), thus allowing the diaphragm element to flex when air is sucked into the air compression chamber when a dart/missile is placed on the tube element (10). The diaphragm element (1) shall be flexible so that when the air compression chamber is expanded to permit air to enter the air compression chamber, the diaphragm element (11) shall bend inwards to permit air to enter through the non-tube openings (12) and when air is expelled from the air compression chamber the diaphragm clement (11) shall bend to seal the non-tube openings (12) thus allowing air pressure to build up in the launch chamber element (8) to the point where the dart/missile is ejected from the tube element (10).

Figure 3:
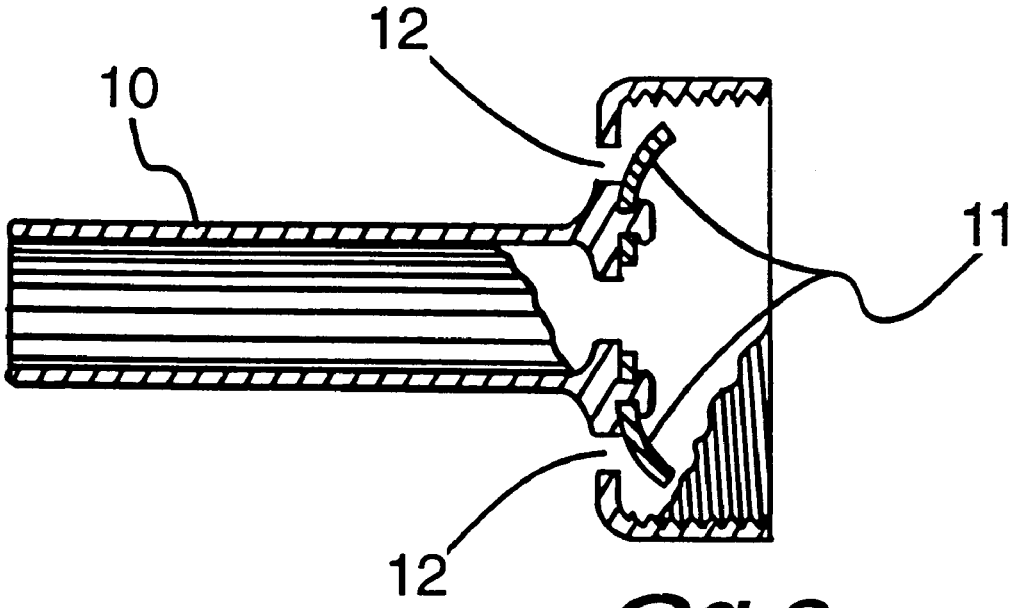
FIG. 3 is a perspective view of the invention for the dart type projectile, showing the view of the launch chamber element from the top where the projectile is inserted over the launch chamber showing the preferable method of the tube element in the center of the base element and circular non-tube openings in the base element with the shadow of the diaphragm element below the non-tube openings.

FIG. 3 shows the same invention as depicted in FIG. 2, with the diaphragm element (11) flexing as air is sucked into the air compression chamber through the non-tube openings (12) when a dart/missile has formed an airtight seal tube element's (10) opening.

Figure 4:
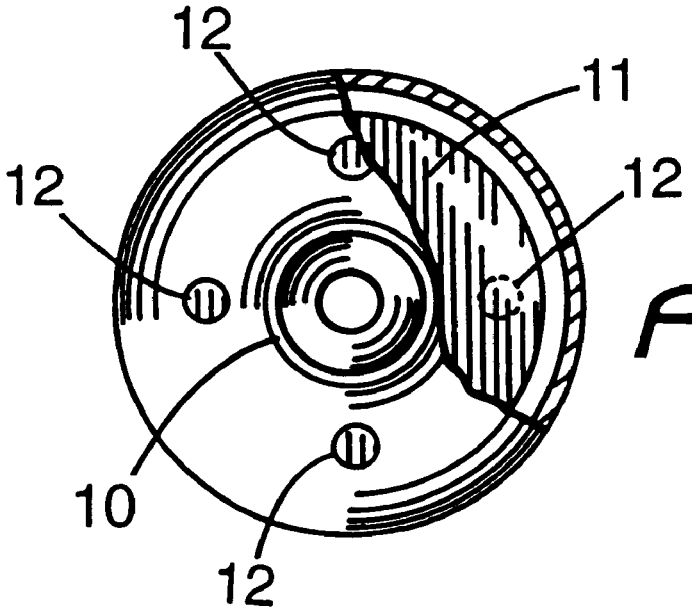
FIG. 4 is a perspective view of the invention for the dart type projectile when the air is being sucked into the air compression chamber and the diaphragm element is flexed.

Referring to drawings, FIG. 4 shows the same invention as depicted in FIG. 2 and 3 from an overhead view. The tube element (10) centered on the base element (9) and illustrates diaphragm element (11) shadow cove the non-tube openings (12). Further, FIG. 4 shows the tube element (10) and the base element (9) being a single piece molded that incorporates both the base element (9) and the tube element (10).

We claim:

1. A flexible ball projectile attachment to a forced air compression chamber comprising of:

a launching chamber element that has a means of attachment to a forced air compression chamber with the end opposite to the means of attachment being open;

the interior of the launching chamber shall have a cylindrical shape that will be at the open end slightly smaller in diameter than the diameter of the intended flexible ball projectile and shall taper becoming slightly larger toward the end attached to the air compression chamber;

the interior of the launching chamber shall have a restricter lip at the open end that will protrude into the interior of the launching chamber element;

the launching chamber element shall be of a length of at least the diameter of the intended flexible ball to be used with the launching chamber element;

the end of the launching chamber element that has the means of attachment to the air compression chamber shall have a base between the interior of the launching chamber element and the means of attachment;

the base shall have an opening in the center of the base sufficient in size to permit air to flow between the air compression chamber and the launching chamber element when the air compression chamber is used;

the base shall have a plurality of posts that surround the opening which shall protrude into the launching chamber element so that the intended flexible ball projectile rests rest on the posts without blocking the opening in the platform.

2. A flexible ball projectile attachment to a forced air compression chamber as described in claim 1 wherein the length of the launching chamber element is sufficient to hold a plurality of intended flexible ball projectiles.

3. A flexible ball projectile attachment to a forced air compression chamber as described in claim 1 wherein the means of attachment to the air compression chamber is a screw threads on the launch chamber element that fit on to the air compression chamber.

4. A flexible dart type projectile attachment to a forced air compression chamber comprising of:

a launching chamber element that is a tube, open at both ends, of a length sufficient to hold the intended flexible dart and has a means of attachment to a base element so that the launching chamber element is perpendicular to the base element;

the exterior of the launching chamber shall be cylindrical and be of an exterior diameter slightly larger than a flexible dart type projectile;

the base element shall have a means of attachment to an air compression chamber and will be open between the launching chamber element and the air compression chamber to permit air to flow between the chambers;

the base element shall have a plurality of non-tube openings that will permit air to pass into the air compression chamber while the flexible dart type projectile is on the launching chamber element;

the base element shall have a flexible diaphragm element that is attached to the base element by a means of attachment and shall be located over the non-tube openings so that when air is expelled out of the air compression chamber the diaphragm element closes the non-tube openings.

5. A flexible dart type projectile attachment to a forced air compression chamber as described in claim 4 wherein the length of the launch chamber is between 1 inch and 4 inches.

6. A flexible dart type projectile attachment to a forced air compression chamber as described in claim 4 where the launch chamber element and base element are one piece.

7. A flexible dart type projectile attachment to a forced air compression chamber as described in claim 4 where the launch chamber element is in the center of the base element.

8. A flexible dart type projectile attachment to a forced air compression chamber as described in claim 6 where the launch chamber element is in the center of the base element.

9. A flexible dart type projectile attachment to a forced air compression chamber as described in claim 4 wherein the means of attachment of the base element to the air compression chamber is a screw threads on the base element that fit on to the air compression chamber.

10. A flexible dart type projectile attachment to a forced air compression chamber as described in claim 6 wherein the means of attachment of the base element to the air compression chamber is a screw threads on the base element that fit on to the air compression chamber.

* * * * *